United States Patent [19]

Gropper

[11] Patent Number: 4,658,571

[45] Date of Patent: Apr. 21, 1987

[54] APPARATUS AND METHOD OF MAKING CLEANING PADS

[76] Inventor: George Gropper, 4084 Greentree Dr., Oceanside, N.Y. 11572

[21] Appl. No.: 792,255

[22] Filed: Oct. 28, 1985

Related U.S. Application Data

[62] Division of Ser. No. 745,143, Jun. 17, 1985.

[51] Int. Cl.[4] ..... B65B 39/14; B65B 43/48

[52] U.S. Cl. ..... 53/576; 156/294; 156/423

[58] Field of Search ..... 156/144, 149, 294, 199, 156/200, 423; 53/521, 523, 524, 530, 526, 527, 436, 438, 439, 469, 479, 574, 575, 576; 15/209 R, 209 B, 209 C, 244, 244 B

[56] References Cited

U.S. PATENT DOCUMENTS

| | | | |
|---|---|---|---|
| 1,949,298 | 2/1934 | Fabel | 53/469 |
| 2,944,588 | 7/1960 | Sannipoli | 156/294 |
| 3,555,775 | 1/1971 | McMillan | 53/576 |

*Primary Examiner*—Michael Wityshyn
*Assistant Examiner*—J. Davis
*Attorney, Agent, or Firm*—Bachman and LaPointe

[57] ABSTRACT

A method and apparatus for making cleaning pads from a tubular meshed network having inner and outer surfaces and a resilient filler by simultaneously turning said meshed network inside out and feeding said tubular meshed network and said filler into a hollow mandrel whereby said filler is enveloped by the reversed tubular meshed network.

8 Claims, 17 Drawing Figures

APPARATUS AND METHOD OF MAKING CLEANING PADS

This is a division of application Ser. No. 745,143 filed June 17,1985.

BACKGROUND OF THE INVENTION

The present invention relates to a new and useful method and apparatus for more efficiently fabricating cleaning pads.

A representative sample of previously known cleaning pads is shown and described in U.S. Pat. No. 4,287,633, issued Sept. 8, 1981 to Gropper entitled Cleaning Pad.

A series of U.S. Pat. Nos. 4,017,949; 4,010,139; and 4,052,238 to Botvin teach methods and an apparatus for continuously knitting plastic or metal filaments into elongated ropes around which are knitted inside out another rope. The completed ropes are divided into individual pads and either heat sealed or stitched closed. The three Botvin references teach the application of vinyl thermoplastic tape 40 which may be reinforced with multiple rows of stitching with between ½ and ¾ inch separation.

It has also been known to produce individual cleaning or scouring pads utilizing separate manual steps of closing one end of a short segment of tubular meshed network, reversing this short segment, inserting a filler therein and then closing the open end.

SUMMARY OF THE INVENTION

The present invention comprises a method and apparatus for producing elongated pad stock.

One aspect of the instant invention teaches a method of fabricating cleaning pad stock (and ultimately individual pad units) from a tubular meshed network having inner and outer surfaces and a resilient filler comprising the steps of drawing said tubular meshed network, outer surface facing outward, over the periphery of a hollow mandrel, and simultaneously turning the tubular meshed network inside out while feeding the network and the filler into said hollow mandrel wherein the filler is enveloped by the tubular meshed network. Other steps in the present invention may include transversely compressing, sealing and cutting the meshed network at spaced intervals to develop pad units.

Another aspect of the present invention includes an apparatus for fabricating cleaning pads from a tubular meshed network having inner and outer surfaces and a resilient filler comprising a hollow mandrel, a ram for supporting and moving the filler, means for moving the ram into and along the longitudinal axis of the hollow mandrel and means for simultaneously grabbing, turning inside out and feeding the meshed network and filler into the hollow mandrel whereby the reversed network envelopes the filler.

BRIEF DESCRIPTION OF THE DRAWINGS

Other features and advantages of the present invention will become apparent from an examination of the succeeding specification when read in conjunction with the appended drawings, in which.

DESCRIPTION OF THE INVENTION

Figure 1:
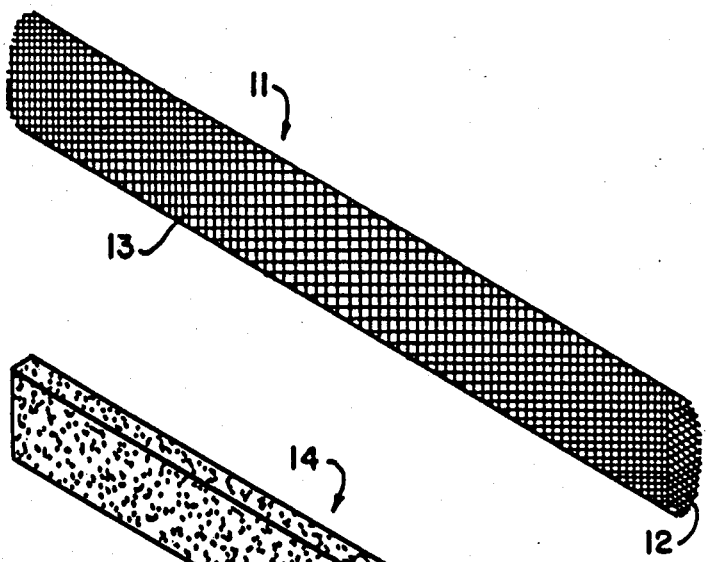
FIG. 1 is a perspective view of a length of outside out tubular meshed network.

Referring to FIGS. 1 through 17 the various method steps of the invention will be described.

The reference numeral 11 represents generally a length of a tubular meshed network defining a sleeve or a sock of material fabricated preferably by knitting synthetic yarn, metallic filaments or a combination thereof.

The sleeve is further characterized as having an "inside" surface 12 and an "outside" surface 13.

The language "tubular" is not intended to be limited to a circular cross-section but includes cross-sections defining a triangle, a rectangle and other polygons.

Although the sleeve 11 will be used ultimately to envelope a filler material and the combined sleeve and filler material (termed cleaning pad stock) will be further fabricated into individual cleaning pad units, it is desirable to turn the sleeve inside out to take advantage of a preferred abrasive condition on the inside surface 12 of the sleeve.

The manner of reversing the sleeve, i.e., turning it inside out, will become apparent as this specification proceeds and as the method steps are described.

Figure 2:
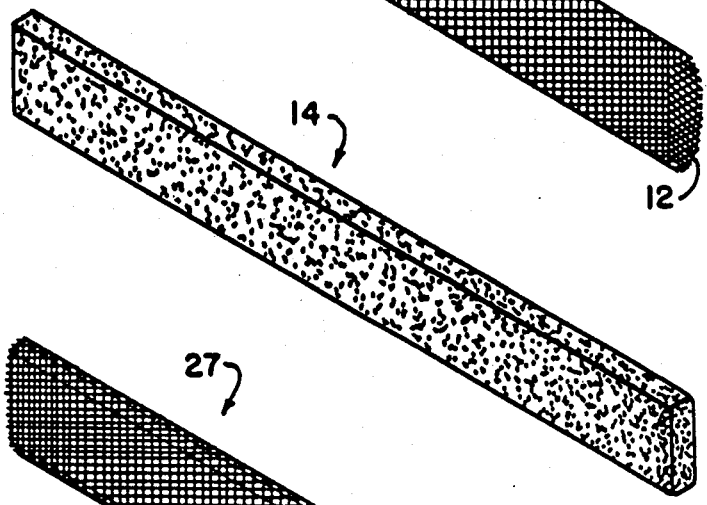
FIG. 2 is a perspective view of a length of resilient filler material.

In FIG. 2 the reference numeral 14 designates a resilient, porous, spongy core or filler, natural or synthetic, of a length generally comparable to the length of sleeve 11.

Figure 3:
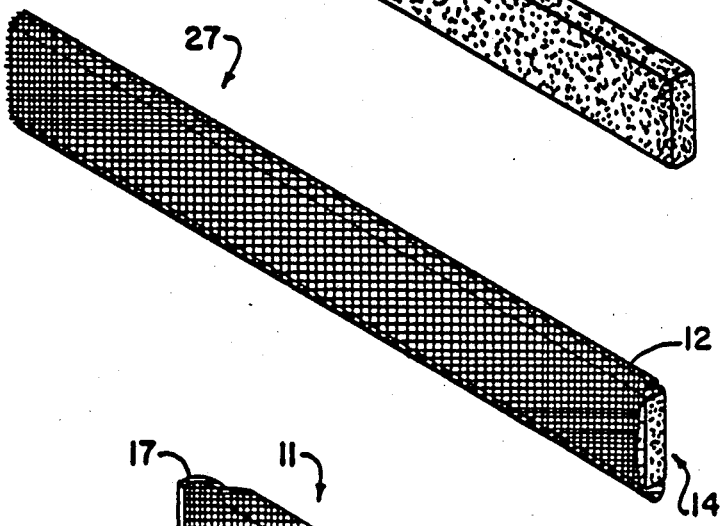
FIG. 3 is a perspective view of the resilient filler eveloped in an inside out tubular meshed network.

FIG. 3 illustrates a fabricated length of pad stock; the sleeve 11 is shown inside surface 12 out, i.e., reversed, enveloping the core or filler 14.

FIGS. 4 through 11 illustrate more specifically steps in arriving at the structure of FIG. 3.

The sleeve 11 with outside surface 13 exposed is drawn and gathered over a hollow mandrel 16 leaving a short "tail" 17 free of the mandrel at the leading or left end 18 of the mandrel.

A receptacle or ram 19 defines a U-shaped relatively rigid trough for supporting and conveying filler 14.

The ram 19 has a hinged sidewall 21 for nipping or pinching the filler to the trough to prevent movement of the filler relative to the ram 19 as the filler is fed into the mandrel.

The leading or right end 22 of the receptacle 19 is formed with a relatively sharp protuberance or needle-like projection or prong 23.

Figure 6:
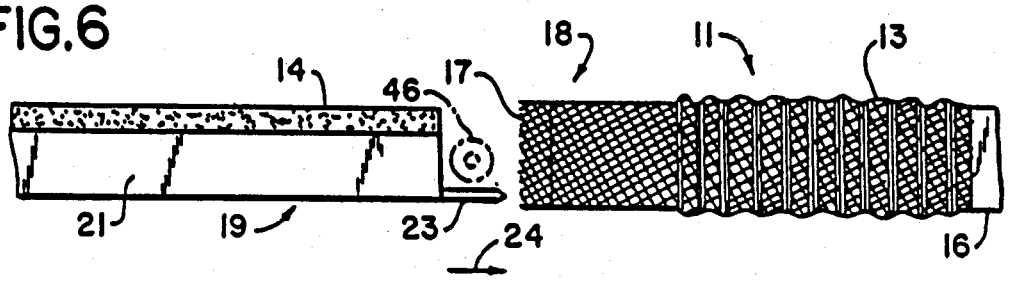
FIG. 6 is a side elevational view of the ram aligned for insertion into the hollow mandrel.

FIG. 6 shows the sleeve 11 loaded on the mandrel 16 in register with the receptacle 19 where the prong 23 is poised to engage and penetrate the tail 17 which overlaps and closes the left end 18 of the hollow mandrel.

The hollow mandrel 16 is dimensioned so as to receive the receptacle 19 including the filler 14 in telescopic fashion.

In timed sequence the receptacle 19 with the filler 14 in place is advanced in the direction of the arrow 24 into the fixed hollow mandrel 16.

The prong 23 pierces the overlapped tail 17 of the sleeve 11 thereby making a physical and positive but releasable connection between the receptacle and the sleeve 11.

As the receptacle proceeds into the hollow mandrel, with the connection between the receptacle and sleeve established, the stroke of the receptacle draws the gathered sleeve off the exterior of the mandrel while reversing the sleeve (or turning it inside out) in the course of its travel.

Figure 7:
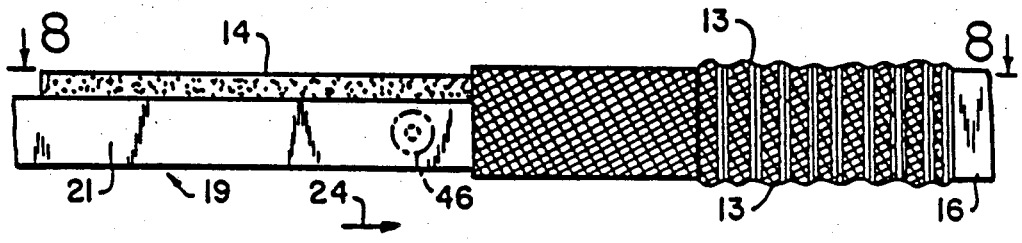
FIG. 7 is a side view of the ram partially inserted into the hollow mandrel.
Figure 8:
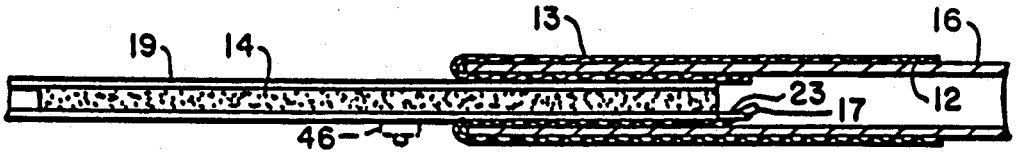
FIG. 8 is a top plan view, partially broken away, in the plane represented by the line 8—8 of FIG. 7.

This occurrence is most apparent in FIGS. 7 and 8 in which stroke of the receptacle is "stopped" to show the prong 23 connected to the tail 17 of the sleeve and the sleeve partially withdrawn, reversed and enveloping the filler and its receptacle. For claiming purposes the receptacle 19 is also termed a conveyor or a ram.

Figure 9:
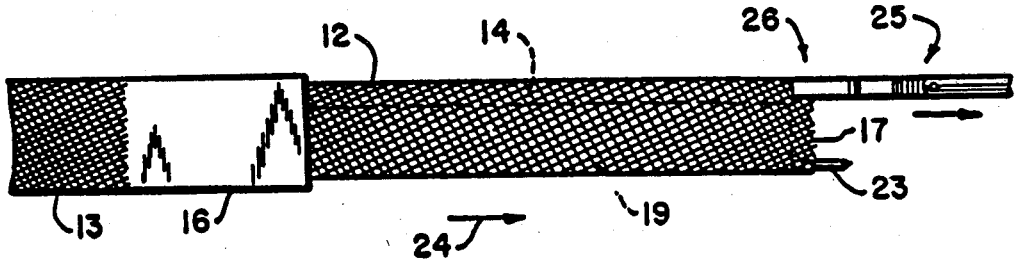
FIG. 9 is a side elevational view of the filler enveloped in the tubular meshed network emerging from the hollow mandrel and being grasped by pincher means.
Figure 10:
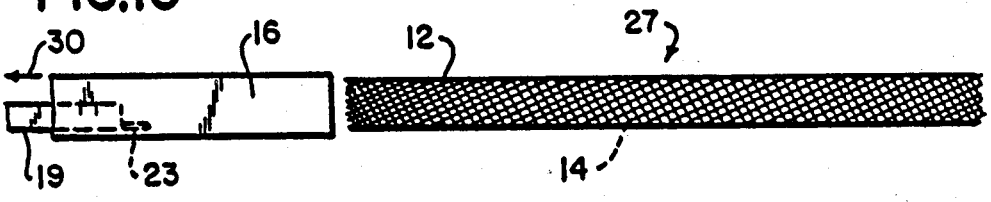
FIG. 10 is a side elevational view showing the filler fully enveloped in the tubular meshed network and withdrawn from the mandrel and from the filler receptacle.

In timed sequence and as soon as the combined filler and sleeve project beyond the right end or outlet end of the mandrel 16, a projecting portion 26 of the combined filler and sleeve (projecting above and slightly beyond the receptacle 19 as is apparent in FIG. 9) is grasped by pinchers 50 and the projecting portion 26 is drawn in the direction of the arrow 24 until the enveloping step is complete and a length of combined inverted sleeve and filler defining cleaning pad stock 27 is pulled free of the mandrel 16 and the receptacle 19 as shown in FIG. 10.

Simultaneously with the grasping and drafting of the portion 26 the receptacle 19 is withdrawn to its initial loading position ready for the receipt of another length of filler 14 to begin a new cycle to generate the next length 27 of pad stock.

After the return stroke of the receptacle 19 the hollow mandrel 16 returns to its upper or loading position as will be more apparent hereinafter.

Since the prong 23 is of needle-like structure it withdraws readily from the tail 17 during the course of separating the combined sleeve and filler from the receptacle 19 during the return stroke 30 of the receptacle 19.

Figure 11:
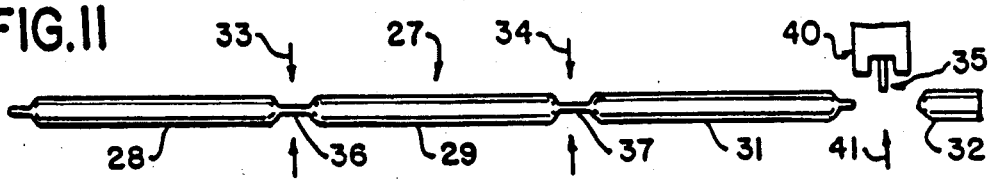
FIG. 11 is a side elevational view showing the steps of compressing, sealing and cutting the enveloped filler into individual pad units.

FIG. 11 shows the steps of converting a length of cleaning pad stock 27 into individual cleaning pad segments or units 28, 29, 31 and 32 at the points indicated by the arrows labelled 33, 34.

There are at least two ways to create the individual pads. At the arrows 33 and 34 the sleeve and filler are compressed and heat sealed or welded to form webs 36 and 37 in well known fashion. Thereafter the webs are severed in the middle of a web.

Alternatively the compressing and heat sealing steps may be combined with severing using a compressing unit 40 combined with a knife 35 as indicated schematically at the reference numeral 41.

FIGS. 12, 13, 14, 15 and 16 show apparatus useful to practice the method steps of the present invention in which a frame 15 having a planar top 20 supports a bracket 25 for hingedly supporting hollow mandrel 16.

The mandrel 16 is movable from its raised, dotted line or loading position to its lowered, solid line or unloading position (by suitable power means, not shown) in register with reciprocating receptacle or ram 19. The receptacle 19 acts as a conveyor for a length of filler material 14 of comparable length to sleeve or meshed network 11 gathered on the mandrel outside 13 out.

Figure 12:
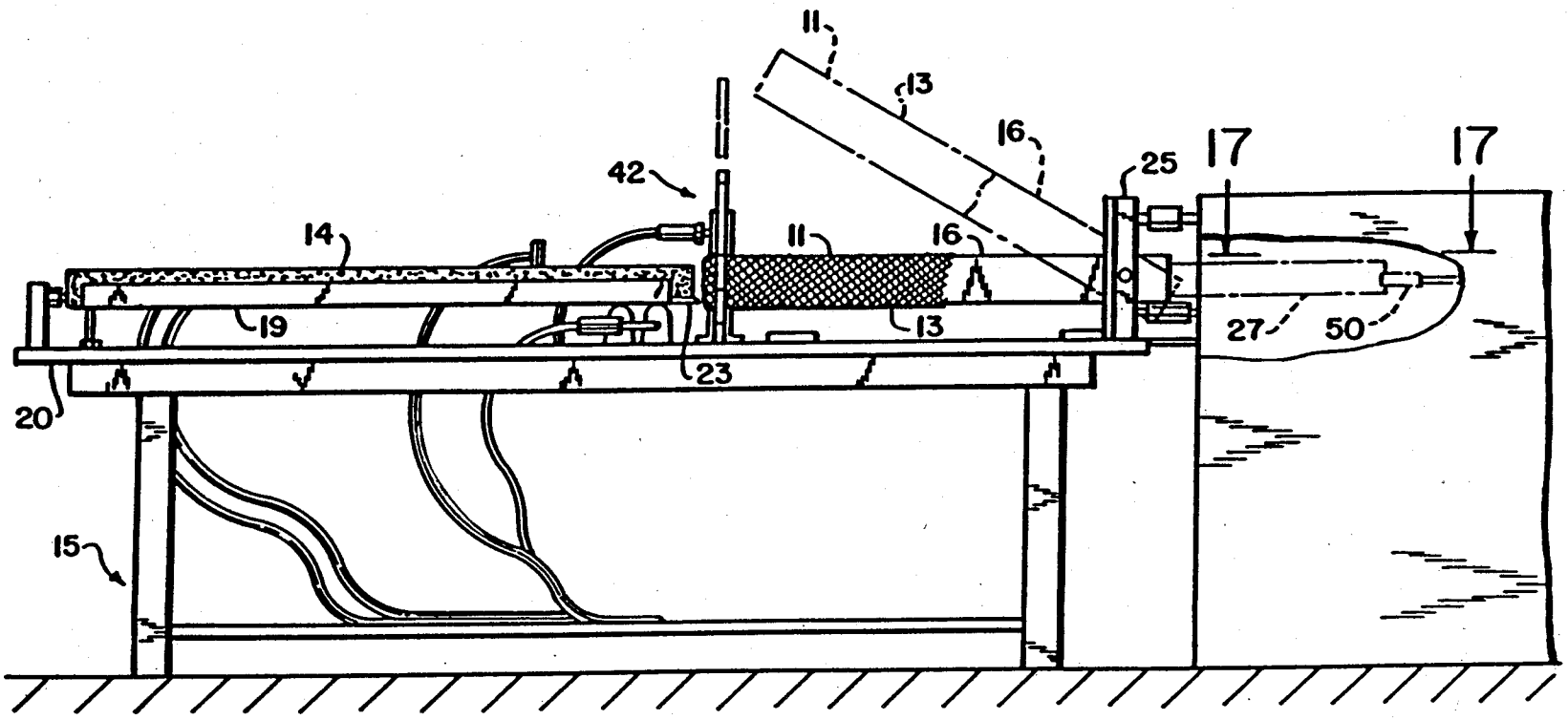
FIG. 12 is a front perspective view of the apparatus of the present invention.

After the mandrel is loaded a pneumatic circuit including appropriate air cylinders, solenoids, micro-switches and photoelectric cells is energized whereupon the mandrel drops to its solid line position and the apparatus cycles automatically to produce a length of combined sleeve and filler defining cleaning pad stock 27 as shown in FIGS. 3, 10 and 12.

Figure 4:
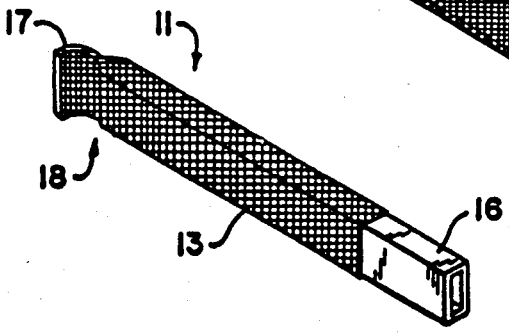
FIG. 4 is a perspective view of the tubular meshed network partially drawn over the periphery of a hollow mandrel.
Figure 5:
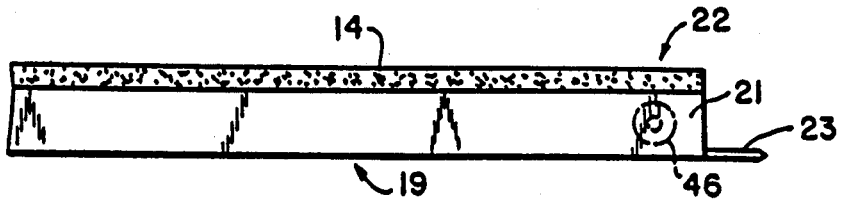
FIG. 5 is a side elevational view of the resilient filler disposed in its receptacle or ram.
Figure 13:
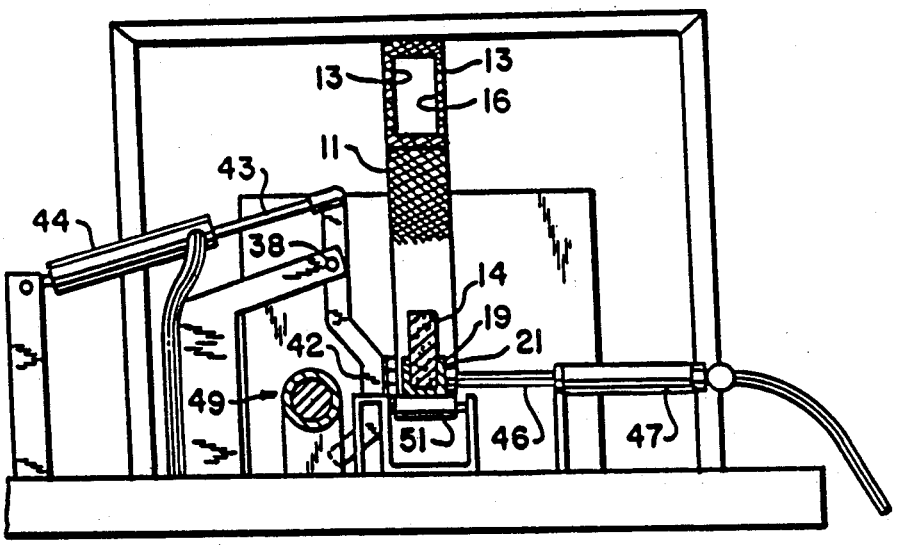
FIG. 13 is a left side elevational view of FIG. 12, partially in section, with the mandrel in the raised position.
Figure 14:
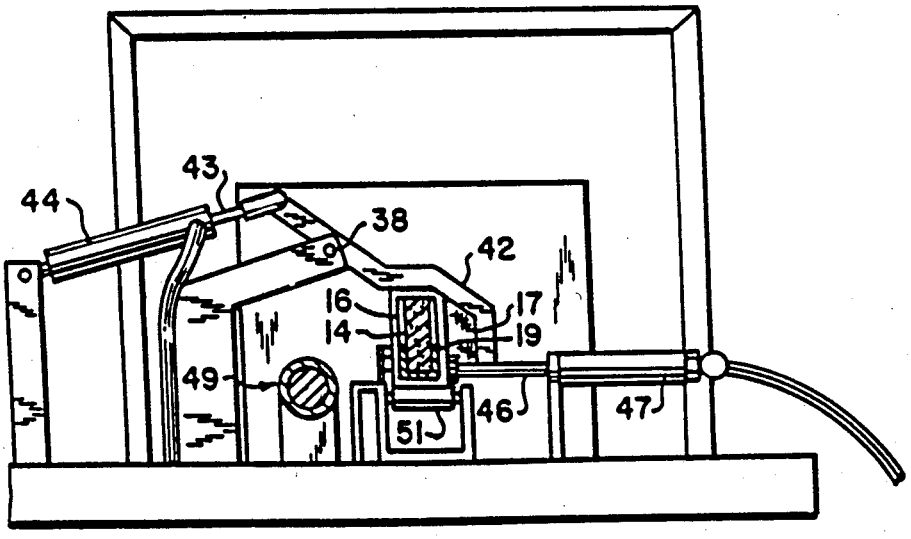
FIG. 14 is a view similar to FIG. 13 with the mandrel in the lowered position.
Figure 15:
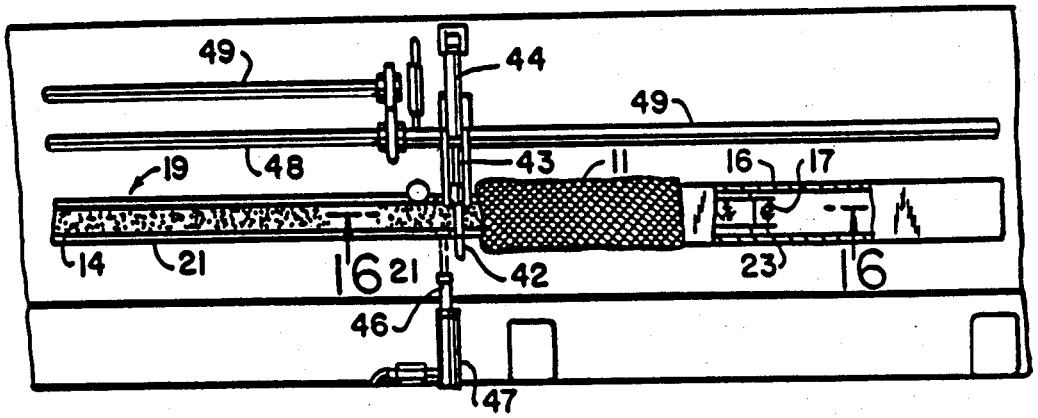
FIG. 15 is a top plan view of a central portion of FIG. 12, partially broken away, for clarity.
Figure 16:
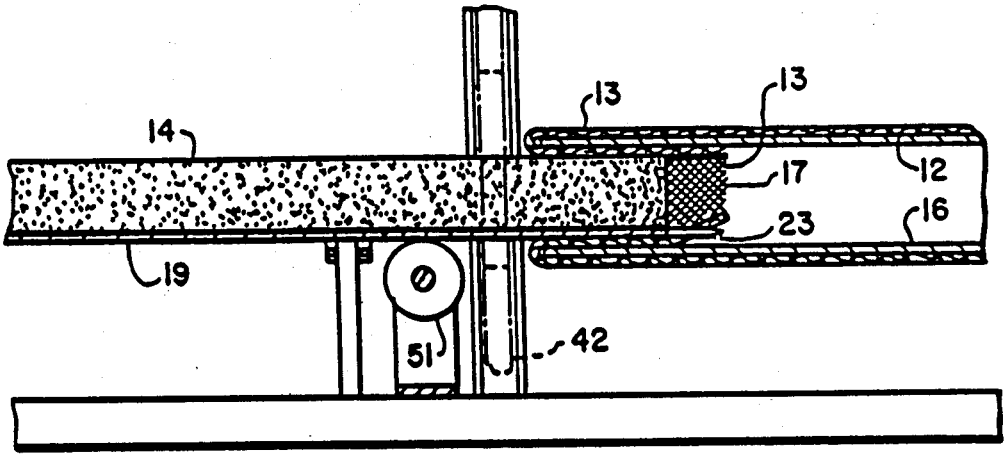
FIG. 16 is an enlarged sectional view of a portion of FIG. 15 in the plane of the line 16—16 of FIG. 15.
Figure 17:
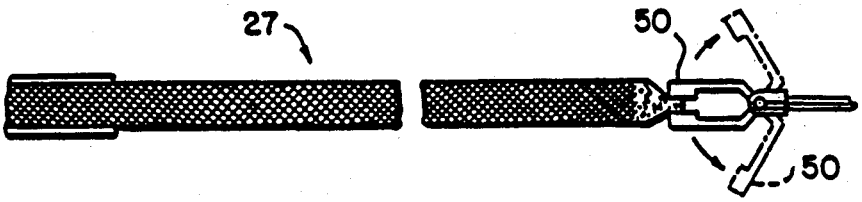
FIG. 17 is a top plan view of the gripper or pincher means.

In timed sequence after the fall of the mandrel 16 a hinged wand 42 is cast by wand piston 43 of cylinder 44 from its idle position of FIG. 13 to its operated position of FIG. 14. The wand 42 pivots about pin 38 and operates to wipe tail 17 of sleeve 11 across the open left end 18 of mandrel 16 to close the end as shown in FIGS. 4 and 14.

In time sequence thereafater snubbing piston 46 of stationary cylinder 47 squeezes hinged sidewall 21 of receptacle 19 to pinch or snub filler 14 snugly in the trough of the receptacle to keep the filler from slipping in the receptacle throughout the next operation.

Virtually simultaneously with the pinching action or snubbing a reciprocating receptacle piston 48 including piston guides 49—49 drives the receptacle 19 carrying filler 14 into the hollow mandrel 16. Snubbing continues throughout the traverse of the receptacle into the hollow mandrel. The connection between the piston 48 and the receptacle 19 is not shown.

The needle-like protuberance or prong 23 engages the sleeve tail 17 thereby making a releasable connection with the sleeve. The receptacle 19 is supported by roller 51 and the wand 42 remains in the operated position of FIG. 14 clear of the advancing receptacle 19.

As stated previously, as the receptacle proceeds into the hollow mandrel 16 the sleeve 11 engaged by the prong 23 is stripped off the mandrel and reversed and the receptacle 19 and its filler 14 are enveloped in the "inside out" sleeve. That is, surface 12 of the sleeve 11 is now on the outside enveloping the filler 14 and the receptacle 19.

When a portion of the combined sleeve and filler project beyond the mandrel as shown in FIG. 9 a photoelectrical cell "reads" this occurrence and a movable set of pinchers 50 grasps the leading end of the combined filler and sleeve and draws the combination out of the mandrel. Simultaneously the signal is given to retract the receptacle 19 from the interior of the mandrel (drawing the receptacle free of the filler and sleeve) and return it to its starting posistion of FIG. 12 ready to receive a new length of filler. Thereafter wand 42 returns to its idle position and the mandrel moves upwardly automatically to its loading position shown in FIGS. 12 and 13.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for fabricating cleaning pad stock from a tubular meshed network and a flexible filler comprising:

a hollow mandrel having an open inlet end and an open discharge end for supporting the main body of the network, a tail portion of the network being unsupported, a ram for supporting, transporting and temporarily stiffening said filler, said ram being operable to be received within and withdrawn from said mandrel in telescopic and cyclic fashion, said ram being coextensive in length with said filler, wand means for bending said tail portion transversely of said mandrel across said open inlet end to close said inlet end, means for creating relative motion between the ram and the mandrel, and means carried by the ram for engaging the tail portion of the network while extending across said inlet end so that when said relative motion occurs the network is stuffed into the mandrel while being withdrawn from said mandrel inside out and the filler and ram are enveloped within the network substantially throughout their respective lengths.

2. The appartus of claim 1 in which the means for creating said relative motion includes a guided piston connected to and operable to drive said ram.

3. The apparatus of claim 1 in which the engaging means defines a protuberance projecting from said ram.

4. The apparatus of claim 1 in which the ram includes means for preventing relative motion between the ram and the filler.

5. The apparatus of claim 4 in which the means for preventing said relative motion includes a hinged element of said ram.

6. The apparatus of claim 3 in which said protuberance defines a needle-like projection at the leading end of the ram.

7. The apparatus of claim 1 in which the wand means includes power means for retaining the wand means stationary during the course of said relative motion between the ram and the mandrel.

8. The apparatus of claim 1 in which the means for creating relative motion between the ram and the mandrel is a piston connected to the ram effective to drive the ram into and draw the ram out of the mandrel through a definite stroke in reciprocatory fashion.

* * * * *